United States Patent [19]

Volat

[11] 4,219,281

[45] Aug. 26, 1980

[54] DEVICE FOR MARKING ARTICLES

[75] Inventor: Jean P. Volat, Paris, France

[73] Assignee: Hotchkiss-Brandt Sogeme H.B.S., Paris, France

[21] Appl. No.: 931,155

[22] Filed: Aug. 4, 1978

[30] Foreign Application Priority Data

Aug. 5, 1977 [FR] France ..... 77 24221

[51] Int. Cl.[2] ..... B41J 3/04; G01D 15/18

[52] U.S. Cl. ..... 400/126; 101/366; 346/140 R

[58] Field of Search ..... 400/126; 346/140, 75; 101/366

[56] References Cited

U.S. PATENT DOCUMENTS

| | | | |
|---|---|---|---|
| 1,997,612 | 4/1935 | Von Webery et al. | 101/366 |
| 3,194,155 | 7/1965 | Davis Jr. | 101/366 |
| 3,375,528 | 3/1968 | Klavsons et al. | 346/140 R |
| 3,570,275 | 3/1971 | Weber et al. | 346/75 |
| 3,885,496 | 5/1975 | Breitweg et al. | 101/366 |
| 4,023,491 | 5/1977 | Kirby, Jr. | 101/366 |
| 4,077,322 | 3/1978 | Fardean et al. | 101/129 |
| 4,083,053 | 4/1978 | Onchi et al. | 346/75 |

FOREIGN PATENT DOCUMENTS

| | | | |
|---|---|---|---|
| 2654823 | 6/1978 | Fed. Rep. of Germany | 400/126 |

OTHER PUBLICATIONS

Heath, *Centrifugal Ink Jet Printer,* IBM Tech. Disclosure Bulletin, vol. 21, No. 11, p. 4668, 4/79.

Smith et al. *Ink Jet Pump,* IBM Tech. Disclosure Bulletin, vol. 20, No. 2, p. 560, 7/77.

*Primary Examiner*—William Pieprz

*Attorney, Agent, or Firm*—Cushman, Darby & Cushman

[57] ABSTRACT

The invention relates to the application of marks to articles by ejecting ink or other marking substances, comprising a first rotary means for ejecting ink in the form of successive jets, a second rotary means to cause the articles intended for marking to pass in front of the ejecting means substantially at the same speed, and a third rotary means to supply the ejecting means with ink, these three rotary means being connected mechanically to the same drive shaft to enable them to be driven.

8 Claims, 10 Drawing Figures

Fig. 8
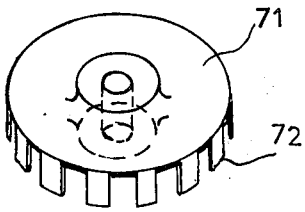
Fig. 4
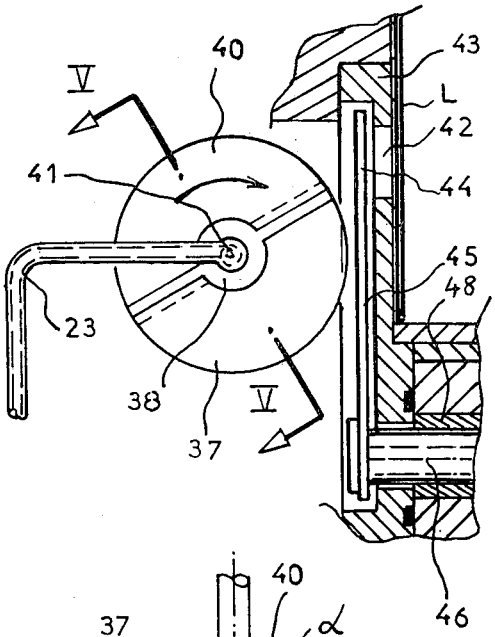
Fig. 9
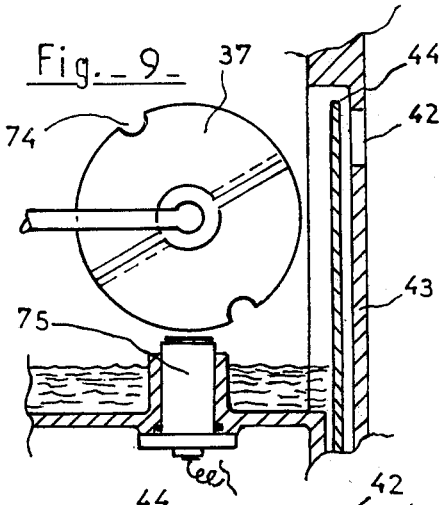
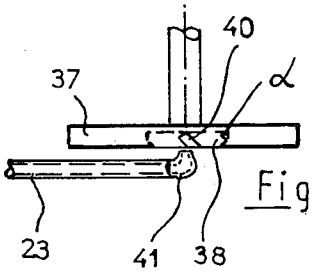
Fig. 5
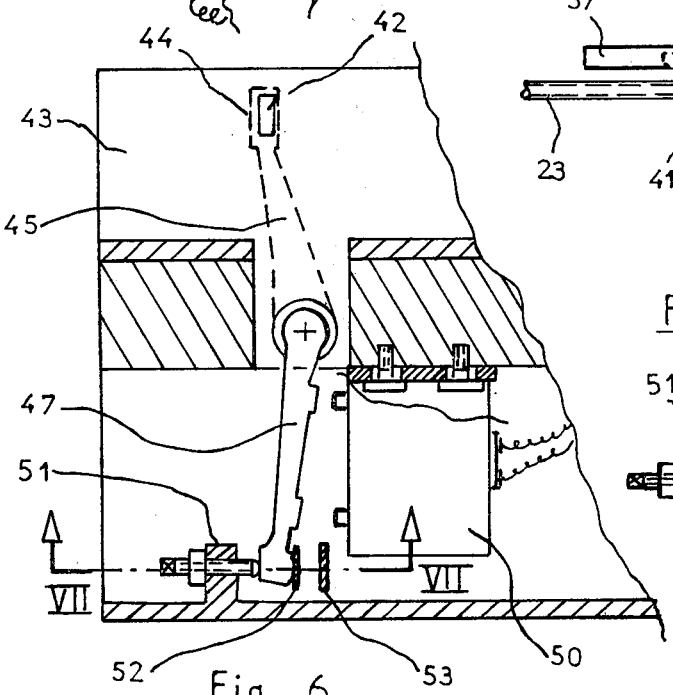
Fig. 6
Fig. 7
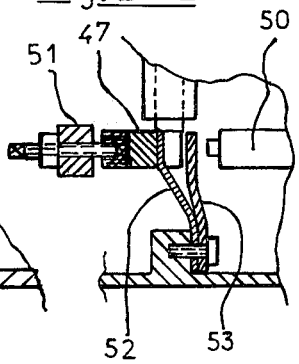

DEVICE FOR MARKING ARTICLES

The present invention, relates to the application of marks to articles by ejecting jets of ink or other marking substances.

The invention is applicable in particular to the application of a coding to letters or other articles, the coding being formed by successive bars which are applied in accordance with a predetermined code.

An object of the invention is to provide a device having constant marking characteristics, in particular as regards the pitch and heavyness of the marks, whilst requiring only a single mechanical drive member ; this device being simple to construct and use and hence has low manufacturing and operating costs.

In accordance with the invention, a device for marking articles comprises a rotary means for ejecting ink in the form of successive jets, a rotary means to cause the articles intended for marking to pass in front of the ejecting means substantially at the same speed, and a rotary means to supply the ejecting means with ink, these three means being connected mechanically to the same drive shaft in order to drive them.

The rotary ink ejecting means is associated with an aperture, which co-operates with an obturator so as to permit or prevent part of a jet from passing through the aperture, the obturator being actuated by an electromagnet.

Synchronisation between the acutation of the obturator and the emission of successive jets of ink is achieved by detecting the position of the rotary ink ejecting means, this detection being achieved by optical and/or magnetic means. These detection means are associated with a roatry member driven mechanically from the said drive shaft and having marks detectable by the detection means. The detection means are also associated directly with the rotary ink ejecting means, this latter rotary means being provided with marks detectable by the detecting means.

Advantageously, the means for ejecting ink is formed by a rotary disc which is provided on one face with at least one groove which opens at its periphery, the disc being associated with an injector which enables ink to be deposited on the said face in an area close to the axis of rotation.

The rotary means for regulating the speed of passage of the articles is formed by a rotary roller against which the said articles are pressed.

The supply of ink is provided by a rotary pump positioned in an enclosure partly filled with ink.

Advantageously, the marking device has a casing divided into two sealed compartments of which one is filled with oil and contains the drive kinematics and of which the other is partly filled with ink and contains the ink supply means and the ink ejecting means.

As indicated above, the invention is applicable in particular to the marking of a coding produced in the from of bars.

There is no limit to the length of the coding.

It is also possible to mark lines of greater or lesser length by leaving the aperture open for a longer or shorter time, each line being formed by a succession of parallel bars.

A code consisting of bars and half-bars may be achieved by using two obturators of which one blocks the window completely while the other blocks only half of it.

The following description, with reference to the accompanying drawings, will give a better understanding of how the invention may be put into practise.

FIG. 4 is a detail view showing the ink ejecting disc associated with an aperture and its obturator.

FIG. 5 is a view taken on line V—V of FIG. 4.

FIG. 6 is a detail view showing how the obturator is actuated by an electromagnet.

FIG. 7 is a sectional view taken on line VII—VII of FIG. 6.

FIG. 8 shows an embodiment of disc for achieving synchronisation between the actuation of the obturator and the emission of successive jets of ink.

FIG. 9 is a view similar to FIG. 4 illustrating a modified version of the synchronisation referred to above.

Figure 1:
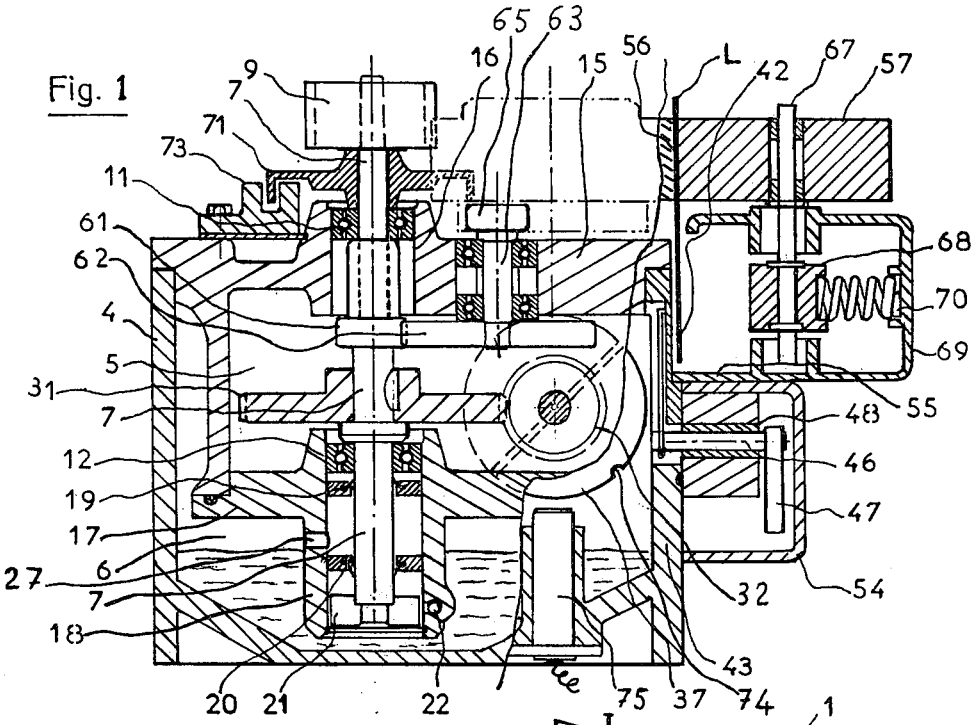
FIG. 1 is an elevational cross-section of a marking device on line I—I of FIG. 2.
Figure 2:
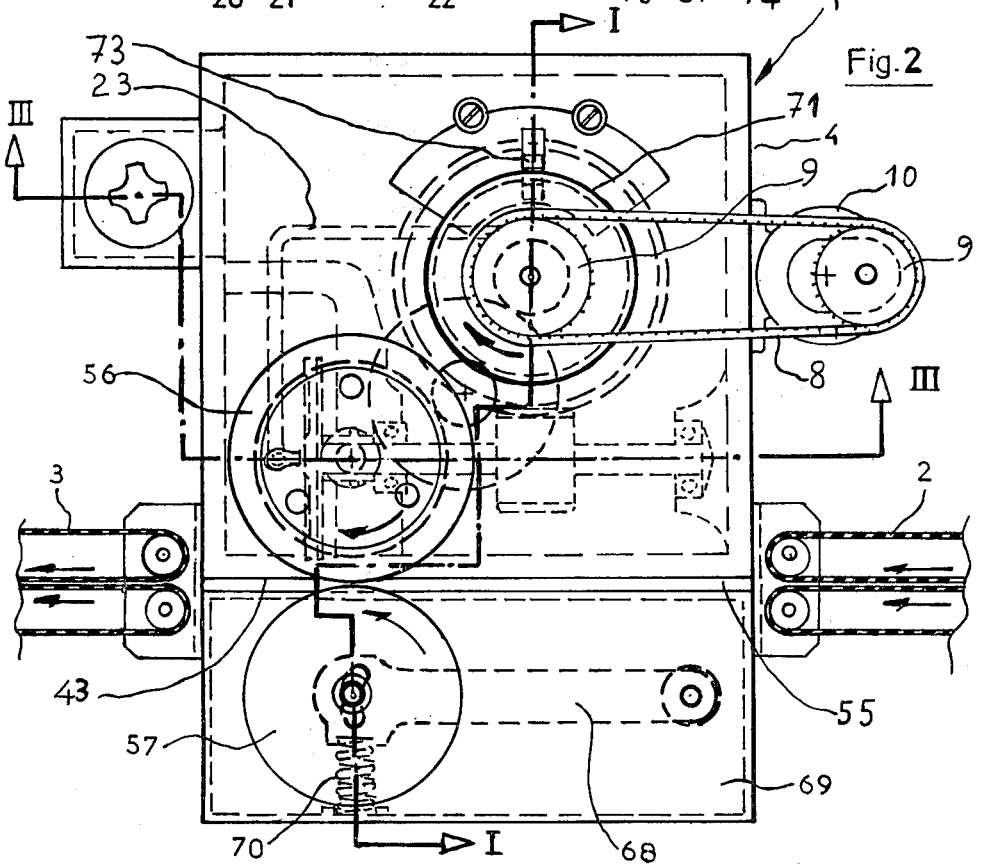
FIG. 2 is a view of the marking device from above.
Figure 3:
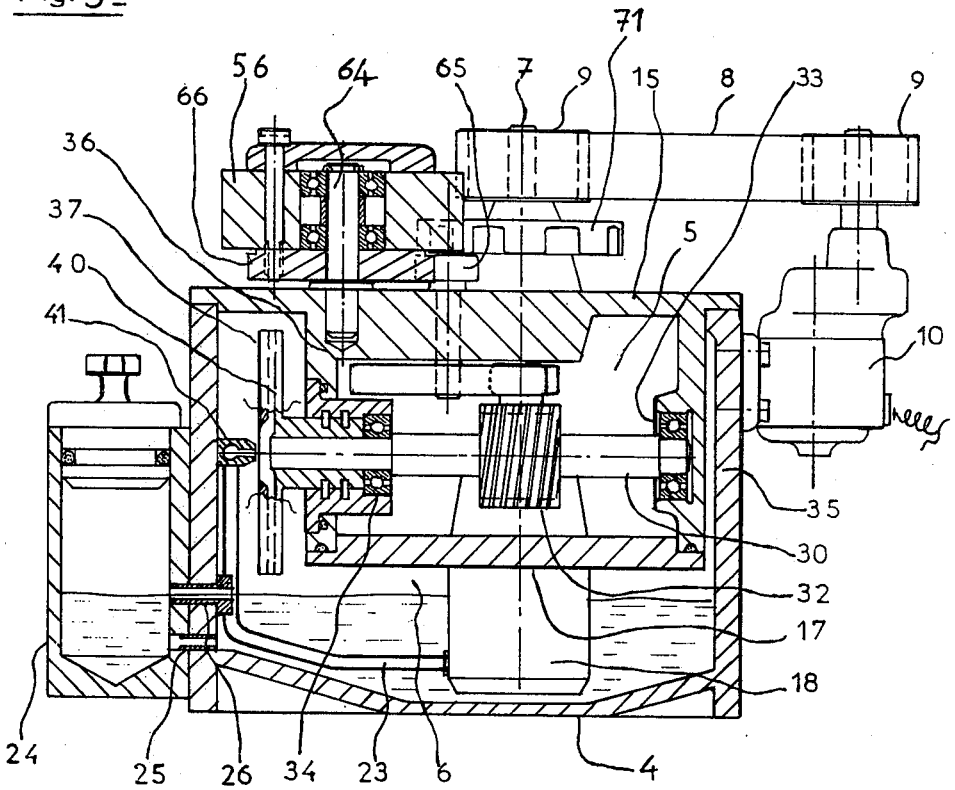
FIG. 3 is a sectional view taken on line III—III of FIG. 2.

In the Figures can be seen a marking installation 1 associated with an infeed conveyor 2 for letters and an output conveyor 3 for the letters.

The installation has a housing 4 which is divided into two closed compartments 5 and 6 which are at least partly filled with oil and ink respectively.

A substantially vertical shaft 7, which is driven from an electric motor 10 via a belt 8 and pulleys 9, passes through the upper wall 15 of the housing 4 in a passage 16, enters compartment 5 and then passes out through a lower partition 17 separating the compartments 5 and 6. It enters compartment 6 surrounded by a cylindrical container 18 formed by an extension of the partition 17. The shaft 7 turns in bearings 11 and 12 which are arranged in the passage 16 and in the upper part of the cylindrical container 18 respectively.

The lower part of the cylindrical container 18 is separated from its upper part by two successive sealing seals 19 and 20 which cooperate with the shaft 7. At its free end the latter carries vanes 21 which rotate close to the free end of the fairing in such a way as to form a pump. Ink enters through the free end of the cylindrical container 18 and is led out through an opening 22 arranged in the cylindrical container opposite the vanes 21 and then through a duct 23.

The compartment 6 is fed with ink from a reservoir 24 which communicates with the compartment 6 via a duct 25 and an overflow 26. Between the seals 19 and 20, the cylindrical container 18 has an opening 27 in its sidewall which enables any ink which might accidentially make its way through seal 20 to be discharged.

In compartment 5 is situated a substantially horizontal shaft 30 which is driven from the vertical shaft 7 by worm gearing made up of two gears 31 and 32 secured to shafts 7 and 30 respectively. The gearing is preferably made such as to drive shaft 30 at a higher speed than shaft 7. Shaft 30, which rotates in two bearings 33, 34 secured to respective ones of the lateral partitions 35, 36 separating compartments 5 and 6, cross through partition 36 so that the crossing of said partition is sealed and enters compartment 6 where it drives a rotary ink ejecting device.

In the embodiment being described, this device is a disc 37 which has a central bowl-like depression 38. It is advantageous for the lateral edge of the bowl 38 to form an acute angle (see in particular FIG. 5) with the bottom of the bowl so as to create a peripheral gutter at the bottom of which the ink, which is subject to centrifugal acceleration, is held.

This gutter communicates with the periphery of the discs 37 via one or more substantially straight radial grooves 40 (of which there are two in the embodiment shown) which are regularly spaced angularly. As can be seen in particular in FIG. 5, the groove 40 is cut obliquely to the face of the disc 37. An injector 41, which is connected to the vane pump 18–21 via duct 23, is arranged substantially opposite the bowl 38 to deposit ink in the central area of the disc 37.

The ink builds up at the bottom of the peripheral gutter in the bowl 38 and then enters the grooves 40 under the effect of centrifugal force and travels towards the periphery with a high accceleration. Finally, it is ejected in the form of a jet following a sweeping trajectory.

The disc 37 rotates in front of a slotted aperture 42 formed in the wall 43 of the housing 4. An obturator formed by a vane 44 can be moved in front of this aperture.

The obturator 44 is secured to an arm 45 which is substantially perpendicular to a shaft 46 to the end of which it is attached. Shaft 46 passes through the wall 43 of the housing 4. It is able to turn in a bush 48.

At its other end, outside the housing 4, it is provided with another arm 47 which is made of a material sensitive to the effect of an electromagnet 50 arranged facing it. The arm 47 and the electromagnet 50 are arranged in a casing 54.

The arm 47 is normally thrust against a stop 51 by a leaf spring 52, the vane 44 then being in the position in which it blocks the jets of ink from passing through. When the electromagnet 50 is energised, the arm 47 is attracted towards it, thus causing the arm 45 to pivot and the aperture 42 to be unblocked. A portion of the jet on a sweeping trajectory emitted by the disc 37 is thus able to pass through the aperture and apply itself to a letter L passing in front of the aperture to mark on the letter a bar-like line.

Figure 10:
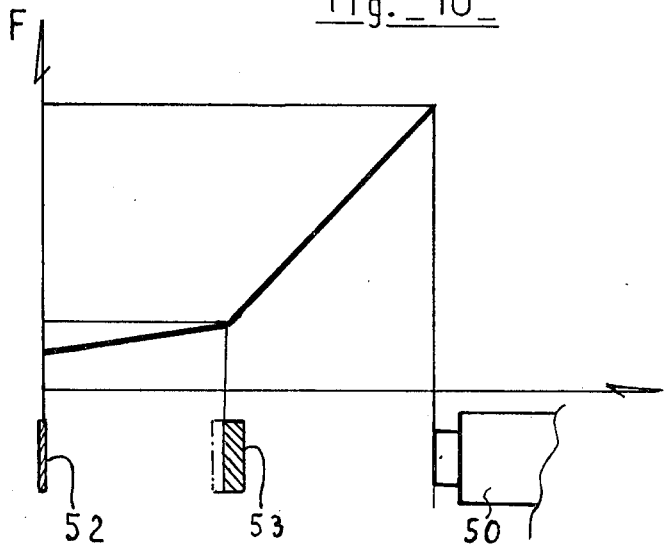
FIG. 10 is a diagram.

A second leaf spring 53 is arranged on the path of the arm 47 between its two extreme positions. Thus, from the time when the electromagnet 50 is brought into operation, the force F with which the arm is returned toward a stop first rises at a relatively shallow gradient determined by the characteristics of spring 52 (See FIG. 10). As soon as the arm 47 encounters the second spring 53, the force F with which the arm is returned increases at a steeper gradient determined by the characteristics by both springs 52 and 53. What is achieved by this arrangement is that the return force F is better adapted to the force of attraction which is generated by the electromagnet on the arm 47 as a function of its position. FIG. 10 is a diagram including a curve illustrating the change in the force F with which the arm 47 is returned by the springs 52, 53 as a function of the position of the said arm between a stop 51 and the electromagnet 50.

The letters L are delivered upright on a horizontal surface 55 by the infeed conveyor 2 along the wall 43 of the housing 4.

They pass between two rollers 56 and 57, the roller 56 being driven in rotation from shaft 7, said rollers 56 and 57 adjust their speed of advance to the appropriate value. They then pass in front of the aperture 42, where they receive their coding, and are then taken hold of by the outfeed conveyor 3.

Roller 56, which is situated above the housing 4, is mounted on a substantially vertical shaft 64 carried by the housing 4. It is driven in rotation from shaft 7 by a transmission. This transmission comprises, successively, gearing made up of gear wheels 61, 62, which drive a shaft 63 substantially parallel to shaft 7 and terminating outside the housing 4, this shaft 63 drives a wheel 65 which co-operates with a wheel 66 secured to roller 56.

Roller 57 is free mounted on a shaft 67 secured to an arm 68 which is pivoted to a structure 69 fixed to the housing 4. A spring 70 co-operates with structure 69 and arm 68 to thrust roller 47 towards roller 56.

When a marking operation is to be performed, the obturator 44 must be actuated so that the aperture 42 is unblocked at the moment when it is reached by the ink jet of sweeping trajectory emitted by the disc 37. It is therefore advisable for this actuation to be synchronised with the position of the grooves 40 in the disc.

For example, use may be made of a disc 71 provided with regularly spaced teeth 72 which is secured to shaft 7. A sensor 73, which may be an optical sensor for example, detects the teeth 72 in front of it, the detection which thus takes place producing an electrical signal directly related to the position of the grooves 40 in the disc 37. By processing this electrical signal the required synchronisation can be achieved.

As an alternative, or in addition (See FIGS. 1 and 9) the disc 37 may itself be provided with cutouts 74 (two in the embodiment illustrated) which are associated with a magnetic proximity detector 75 which detects their passage. This detector may be of the oscillator type sensitive to the presence of a mass of metal. It is positioned in the housing 4 close to the electromagnet 50.

The marking device 1 which has just been described enables all kinds of marks in bar form to be made on articles such as letters which pass in front of it. What may be concerned in particular is postal coding consisting in applying bars in accordance with a predetermined code.

The operation of the marking device 1 will be apparent from the foregoing description.

Starting up the motor 10 causes the disc 37, the pump 18, 21, the roller 56 and the disc 71 to start turning. The disc 37 emits jets in a sweeping trajectory which are stopped by the housing 4 and the obturator 44 if not actuated.

When a letter L passes in front of the aperture 42, the necessary electrical signals are fed to the electromagnet 50 to cause the aperture 42 to be unblocked or left blocked when each ink jet arrives, as dictated by the coding to be applied to the letter.

The height of the bars is determined by the height of the exit slot 42. The width of the bars is determined by adjusting the throughput of ink. The pitch of the markings is determined by the speed of passage of the letters and the number of ink jets ejected per second. It is therefore governed by the ratio between the tangential speed of the roller 56 and the speed of rotation of disc 37. However, roller 56 and disc 37 are driven mechanically from one and the same member, namely shaft 7. The result is that the pitch of the bars is substantially independent of the speed of rotation of shaft 7.

Similarly, disc 37 and the pump 18, 21 are driven mechanically from the same shaft 7 and thus turn at speeds of rotation which are in a constant ratio to one another. However, the pump supplies ink to the injector 41 at a pressure which is substantially proportional to the square of its speed of rotation. The output of ink from the injector, which varies as the square root of the said pressure, is therefore proportional to the speed of rotation of the pump and thus of the disc. As a result the intensity of the applied marking is independent of the speed of rotation of the shaft 7.

This demonstrates the importance of the mechanical connection to a single drive member of the roller 56 which is responsible for adjusting the speed of passage of the letters, of the disc 37 which is responsible for ejecting successive ink jets, and of the pump 18, 21 which is responsible for adjusting the rate of supply of ink.

This is achieved in the marking system which has been described by causing the shaft 7 to pass through three separate zones, namely:

an ink zone formed by the enclosure 6, an oil zone containing all the kinematics, formed by the enclosure 5, an external zone in air for the electromagnet 50, roller 56, synchronising disc 71, etc.

This results in a compact and simple (and therefore low cost) design which is easily constructed.

What is claimed is:

1. Device for marking articles by ejecting jets of ink or other marking substance, comprising: gearing; a housing divided into a first and a second closed compartment, said first compartment containing said gearing, said second compartment being at least partly filled with marking substance; a substantially vertical shaft driven from an electrical motor, traversing said first and second compartment; a substantially horizontal shaft lcoated in said first compartment driven by said vertical shaft through said gearing; first rotary means, driven by said horizontal shaft, for ejecting marking substance in the form of successive jets; second rotary means, driven by said vertical shaft, for causing the articles intended for marking to pass in front of said first rotary means substantially at the same speed; means, defining a duct between said second compartment and said first rotary means, for transporting said marking substance to said said first rotary means; and third rotary means, driven by said vertical shaft and located in said second compartment, for supplying via said duct said first rotary means with marking substance; said first, second and third rotary means being mechanically connected to said vertical shaft in order to drive them, the intensity of applied marking thereby being independent of the speed of rotation of said vertical shaft.

2. Device according to claim 1, wherein said first rotary means for ejecting ink in the form of successive jets is associated with an aperture which co-operates with an obturator to allow a portion of a jet to pass or not to pass through the aperture, said obturator being actuated by an electromagnet.

3. Device according to claim 2, further comprising means for detecting the position of said first rotary means and achieving synchronisation between the actuation of said obturator and the emission of successive jets of ink.

4. Device according to claim 3, wherein said detecting means are associated with a rotary member driven mechanically from the said vertical shaft which has marks detectable by said detecting means.

5. Device according to claim 3, wherein said first rotary means for ejecting ink are directly associated with detecting means and provided with marks which are detectable by said detecting means provided.

6. Device according to claim 1 wherein said first rotary means for ejecting ink are formed by a rotary disc provided on one face with at least one groove opening at its periphery, this disc being associated with an injector which enables ink to be deposited on the said face in an area close to its axis of rotation.

7. Device according to claim 1 wherein said second rotary means are formed by a rotary roller against which the said articles are pressed.

8. Device according to claim 1 wherein said third rotary means are formed by a rotary pump positioned in an enclosure partly filled with ink.

* * * * *